US005365949A

United States Patent [19]

Nishizaka et al.

[11] Patent Number: 5,365,949

[45] Date of Patent: Nov. 22, 1994

[54] METHOD OF DETECTING DEVIATION IN POSITION AND MISSHAPE OF TRANSPORTED OBJECTS

[75] Inventors: Toshiaki Nishizaka; Hirokazu Takamori; Tuyoshi Hashimoto, all of Fukuoka, Japan

[73] Assignee: Japan Tobacco Inc., Tokyo, Japan

[21] Appl. No.: 913,364

[22] Filed: Jul. 15, 1992

[30] Foreign Application Priority Data

Jul. 15, 1991 [JP] Japan ..... 3-173795

[51] Int. Cl.[5] ..... A24C 5/00

[52] U.S. Cl. ..... 131/280; 131/94; 198/360

[58] Field of Search ..... 131/94, 91, 280; 198/459, 460

[56] References Cited

U.S. PATENT DOCUMENTS

| | | | |
|---|---|---|---|
| 3,874,391 | 4/1975 | Dogl et al. | 131/94 X |
| 4,044,779 | 8/1977 | Preston et al. | 131/94 |
| 5,022,644 | 6/1991 | Burge | 198/460 X |
| 5,038,915 | 8/1991 | Delsanto | 198/460 X |
| 5,165,520 | 11/1992 | Herve et al. | 198/460 |

FOREIGN PATENT DOCUMENTS

| | | |
|---|---|---|
| 0042665 | 5/1981 | European Pat. Off. . |
| 0237288 | 3/1987 | European Pat. Off. . |
| 795480 | 5/1958 | United Kingdom . |

*Primary Examiner*—Jennifer Bahr

[57] ABSTRACT

This invention relates to a method of detecting deviation in position and misshape of transported objects which have a predetermined shape and are successively transported at predetermined intervals with the transported objects being maintained in a predetermined direction, comprising the steps of: generating synchronizing signals corresponding to the transportation intervals on a predetermined cycle; detecting passage of end portions of the transported objects at predetermined positions; calculating a time interval between the generation of the synchronizing signals and the passage of the end portions; calculating a mean value and a standard deviation for a prescribed number of the transported objects from time series information; judging a transported object as an object of which position is deviated or shape is deformed when the difference between measured time interval and the mean time interval is larger than a criterion which is calculated based on the standard deviation; replacing the oldest information on the time interval in the time series information with information on time interval of a transported object which is judged that a position thereof is not deviated or a shape thereof is not deformed to renew the time series information; and calculating a mean value and a standard deviation for the renewed time series information so as to be used for the judgment.

30 Claims, 10 Drawing Sheets

METHOD OF DETECTING DEVIATION IN POSITION AND MISSHAPE OF TRANSPORTED OBJECTS

BACKGROUND OF THE INVENTION

1. Field of the Invention

This invention relates to a method of detecting deviation in position and misshape of transported objects and more particular to a method of detecting those of tip paper which is used for tipping a filter portion of a cigarette in cigarette manufacturing process.

2. Description of the Prior Art

A conventional cigarette with a filter is manufactured in such a manner that a filter plug is positioned between plain cigarettes under the condition that both ends of the filter plug abut an end of the plain cigarettes each, and then a rectangular pieces of tip paper with paste is rolled to envelop the filter plug. Then, after pasting and drying process, the center portion of the filter plug is cut to form a cigarette. The process for rolling the plain cigarette and the filter plug with the piece of tip paper is performed by so-called a filter tip attaching apparatus.

FIG. 12 shows a section for feeding tip paper in a conventional cigarette manufacturing system. The tip paper P is delivered from a tip paper bobbin 10 to a pasting section through delivering rollers 20 and paste is transferred to one side of the tip paper P at the pasting section 30. The tip paper with paste is cut to obtain pieces of paper with a predetermined dimension by a suction roller 40, which rotates at a predetermined velocity, and a knife 50 as illustrated in FIG. 11. Then, the pieces p of tip paper are sucked on a drum face 40*a* of the suction roller 40 so as to be fed to the transfer drum 60 side with the pasted side of the paper turned up as shown in FIG. 12. The filter plug and the plain cigarette are fed to the transfer drum 60 from an apparatus not shown.

FIG. 10 shows a portion adjacent to the suction roller 40 and the transfer drum 60. On the drum face of the transfer drum 60 are disposed the filter plugs F and supporting members 60*a* in which inner diameter of a spherical face thereof, which turns outwardly, is the same as the diameter of the plain cigarette at the predetermined intervals in accordance with the intervals of the pieces of tip paper transported. Further, the aligned filter plugs and the plain cigarette are successively transported to the suction roller side while being sucked on the supporting member, the pieces p of tip paper each is stuck to the filter plug with a portion from the tip and around 2 mm to 3 mm therefrom in parallel with the filter plug and the plain cigarette at a portion adjacent to the transfer drum 60 and the suction roller 40. Then, the filter plug and plain cigarette are rolled and stuck together by a heater drum and a rolling hand not shown to produce double filter cigarettes.

However, at an initial stage of the tipping process with the tip paper as described above, the pieces of tip paper are cut into predetermined dimension and are transported on the drum face of the suction drum at certain intervals. Therefore, unless the pieces of the paper are stuck on predetermined portions of both the filter plug and the plain cigarette, the rolling operation at the next stage, in which the filter plug and the plain cigarette are rolled up, may be improper, which causes a defect to be produced.

Therefore, as exemplarily shown in FIG. 9, light projecting and receiving portions $\mathbf{11}_A$ and $\mathbf{11}_B$ of a pair of photoelectric detectors $\mathbf{1}_A$ and $\mathbf{1}_B$ are disposed in the direction vertical to the transporting direction through the suction roller 40, that is, in the direction as indicated by an arrow in the figure, to oppose the dram face 40*a*. Then, as shown in FIG. 8, the light projecting and receiving portions $\mathbf{11}_A$ and $\mathbf{11}_B$ project a pair of light spots $S_A$ and $S_B$ toward the drum face 40*a* and then the light reflected from both ends of the pieces p of the transported paper is received. Then, timing of the output signals of the photoelectric detectors $\mathbf{1}_A$ and $\mathbf{1}_B$ based on received light quantity and timing of synchronizing signals are compared with each other to detect the deviation in position and improper cutting of the pieces of the tip paper.

Meanwhile, on the drum face 40*a* of the suction roller 40 is formed a number of suction holes in rectangular areas which are provided at certain intervals in the direction that the pieces p of tip paper are transported, so that the suction roller 40 sucks the pieces p of tip paper with the suction holes 40*b* using vacuum force.

In the above structure, the spots $S_A$ and $S_B$ are formed at the same distance from, and slightly inward positions relative to, both ends of the pieces p of tip paper in normal transportation. The reflectivity of the drum face 40*a* is higher than that of the pieces p of tip paper due to mirror finishing. Nevertheless, the direction of the light projecting and receiving portions $\mathbf{11}_A$ and $\mathbf{11}_B$ are slant relative to a tangent line of the drum face 40*a* as shown in FIG. 9, consequently the quantity of the light which enters the light projecting and receiving portion $\mathbf{11}_A$ and $\mathbf{11}_B$ increases when pieces p of the paper are positioned at the spots $S_A$ and $S_B$ rather than when the drum face 40*a* is positioned. Therefore, unless the pieces p of tip paper are slipped in the direction vertical to the transporting direction, tip paper detecting signals are outputted from the photoelectric detectors $\mathbf{1}_A$ and $\mathbf{1}_B$ as indicated in FIG. 7.

Therefore, as exemplarily illustrated in FIG. 6, synchronizing signals a are generated at certain intervals according to the transportation intervals of the suction roller 40, and gating signals $g_A$ and $g_B$ are generated before and after the synchronizing signals a to observe whether or not the rising or falling of tip paper detecting signals $e_A$ and $e_B$ each from the photoelectric detector $\mathbf{1}_A$ and $\mathbf{1}_B$ is detected within the range determined by the gating signals $g_A$ and $g_B$ each, which permits the slipping in position and improper cutting of the pieces of the tip paper to be detected.

With the detecting method described above, although the narrower the width of the gating signals the higher the accuracy for detection, there is a deviation in the interval of the pieces of tip paper due to the mechanical structure including the suction roller, the knife, and a tip paper feeding portion. Therefore, the width of the gating signals should be determined in consideration of certain tolerance.

Therefore, at present, the width of the gating signal is determined according a variety of factors such as adjusting error in a day, daily error, human error, in position of the tip paper, which are calculated from tip paper detecting signals sampled, and error in sensitiveness of the photoelectric detector, which affects the position of the rising and the falling of the tip paper detecting signals.

However, when the width of the gating signals is set as described above, the accuracy for detection becomes poor since such errors are all contained.

SUMMARY OF THE INVENTION

It is therefore the object of the present invention to automatically detect the deviation in position and misshape of transported objects with predetermined dimensions which are successively transported at predetermined intervals, like pieces of tip paper successively transported in tobacco manufacturing process, and to improve the accuracy for detecting the deviation in position and misshape of the transported objects.

Another object of the present invention is to provide a method for detecting a deviation of an object from a desired state, said object being transported along a path in a serial fashion in a stream formed of a plurality of substantially similar discrete objects comprising the steps of: transporting the objects along the path; producing periodic synchronizing signal pulses; producing an alpha signal when said object reaches a first reference point on said path; producing a beta signal when said object has passed said first reference point; counting an alpha count, starting with said alpha signal and stopping upon detecting a synchronizing pulse subsequent to said alpha count being started; counting a beta count, starting with said beta signal and stopping upon detecting a synchronizing pulse subsequent to said beta count being started; comparing a function of said alpha count against a desired comparison value to produce an alpha comparison; comparing a function of said beta count against a desired comparison value to produce a beta comparison; and determining as a function of said alpha and beta comparisons whether an object's state deviates from a desired state.

Another object of the present invention is to provide a method for detecting a deviation of an object from a desired state, said object being transported along a path in a serial fashion in a stream formed of a plurality of substantially similar discrete objects comprising the steps of: transporting the objects along the path; producing periodic synchronizing signal pulses; producing an alpha signal when said object reaches a first reference point on said path; producing a beta signal when said object has passed said first reference point; counting an alpha count, starting with said alpha signal and stopping upon detecting a sychronizing pulse subsequent to said alpha count being started; counting a beta count, starting with said beta signal and stopping upon detecting a sychronizing pulse subsequent to said beta count being started; comparing a function of said alpha count against a desired comparison value to produce an alpha comparison; comparing a function of said beta count against a desired comparison value to produce a beta comparison; and determining as a function of said alpha and beta comparisons whether an object's state deviates from a desired state; producing a gamma signal when said object reaches a second reference point on said path; producing a delta signal when said object has passed said second reference point; counting a gamma count, starting with said second start signal and stopping upon detecting a synchronizing pulse subsequent to said gamma count being started; counting a delta count, starting with said second start signal and stopping upon detecting a synchronizing pulse subsequent to said delta count being started; comparing a function of said gamma count against a desired value to produce a gamma comparison; comparing a function of said delta count against a desired value to produce a delta comparison; and determining as a function of said gamma and delta comparisons whether an object's state deviates from a desired state.

Another object of the present invention is to provide a method for detecting a deviation of an object from a desired state, said object being transported along a path in a serial fashion in a stream formed of a plurality of substantially similar discrete objects comprising the steps of: transporting the objects along the path; producing periodic synchronizing signal pulses; producing an alpha signal when said object reaches a first reference point on said path; producing a beta signal when said object has passed said first reference point; counting an alpha count, starting with said alpha signal and stopping upon detecting a synchronizing pulse subsequent to said alpha count being started; counting a beta count, starting with said beta signal and stopping upon detecting a synchronizing pulse subsequent to said beta count being started; comparing a function of said alpha count against a desired comparison value to produce an alpha comparison; comparing a function of said beta count against a desired comparison value to produce a beta comparison; determining as a function of said alpha and beta comparisons whether an object's state deviates from a desired state; producing a gamma signal when said object reaches a second reference point on said path; producing a delta signal when said object has passed said second reference point; counting a gamma count, starting with said second start signal and stopping upon detecting a synchronizing pulse subsequent to said gamma count being started; counting a delta count, starting with said second start signal and stopping upon detecting a synchronizing pulse subsequent to said delta count being started; comparing a function of said gamma count against a desired value to produce a gamma comparison; comparing a function of said delta count against a desired value to produce a delta comparison; and determining as a function of said gamma and delta comparisons whether an object's state deviates from a desired state; said first reference point is located near a first boundary, said first boundary being a function of said desired state of said object; said second reference point is located near a second boundary, said second boundary being a function of said desired state of said object.

The present invention has been accomplished to solve the above problem and it is an object of the present invention to provide a method of detecting deviation in position and misshape of transported objects which have a predetermined shape and are successively transported at predetermined intervals with the transported objects being maintained in a predetermined direction, comprising the steps of: generating synchronizing signals corresponding to the transportation intervals on a predetermined cycle; detecting passage of end portions of the transported objects at predetermined positions; calculating a time interval between the generation of the synchronizing signals and the passage of the end portions; calculating a mean value and a standard deviation for a prescribed number of the transported objects from time series information; judging a transported object as an object of which position is deviated or shape is deformed when the difference between measured time interval and the mean time interval is larger than a criterion which is calculated based on the standard deviation; replacing the oldest information on the time interval in the time series information with information on time interval of a transported object which is judged that a position thereof is not deviated or a shape thereof is not deformed to renew the time series information; and calculating a mean value and a standard deviation for the renewed time series information so as to be used for the judgment.

In the method of detecting deviation in position and misshape of transported objects according to the present invention, the synchronizing signals are generated in accordance with the transportation interval of the transported objects on a predetermined cycle. The passage of the end portions of the transported objects is detected at predetermined positions by the photoelectric detector or the like.

Then, a mean value and a standard deviation are calculated from time series information for a prescribed number of the transported objects.

Next, a transported object is judged as an object of which position is deviated or shape is deformed when the difference between the measured interval data and the mean time interval is larger than a criterion which is calculated based on the standard deviation.

The oldest information on the time interval in the above time series information is replaced with information on the time interval for the objects of which position is not deviated or shape is not deformed to renew the time series information; and a mean value and a standard deviation are calculated for the renewed time series information so as to be used for the judgment.

As a result, the criterion is determined based on the data on a predetermined number of transported objects which are not judged as defective. Then, the criterion is preferably used for judging a transported object which follows the predetermined number of transported objects.

The foregoing and other objectives of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be more apparent from the ensuring description with reference to the accompanying drawing wherein.

DETAILED DESCRIPTION OF PREFERRED EMBODIMENTS

Figure 1:
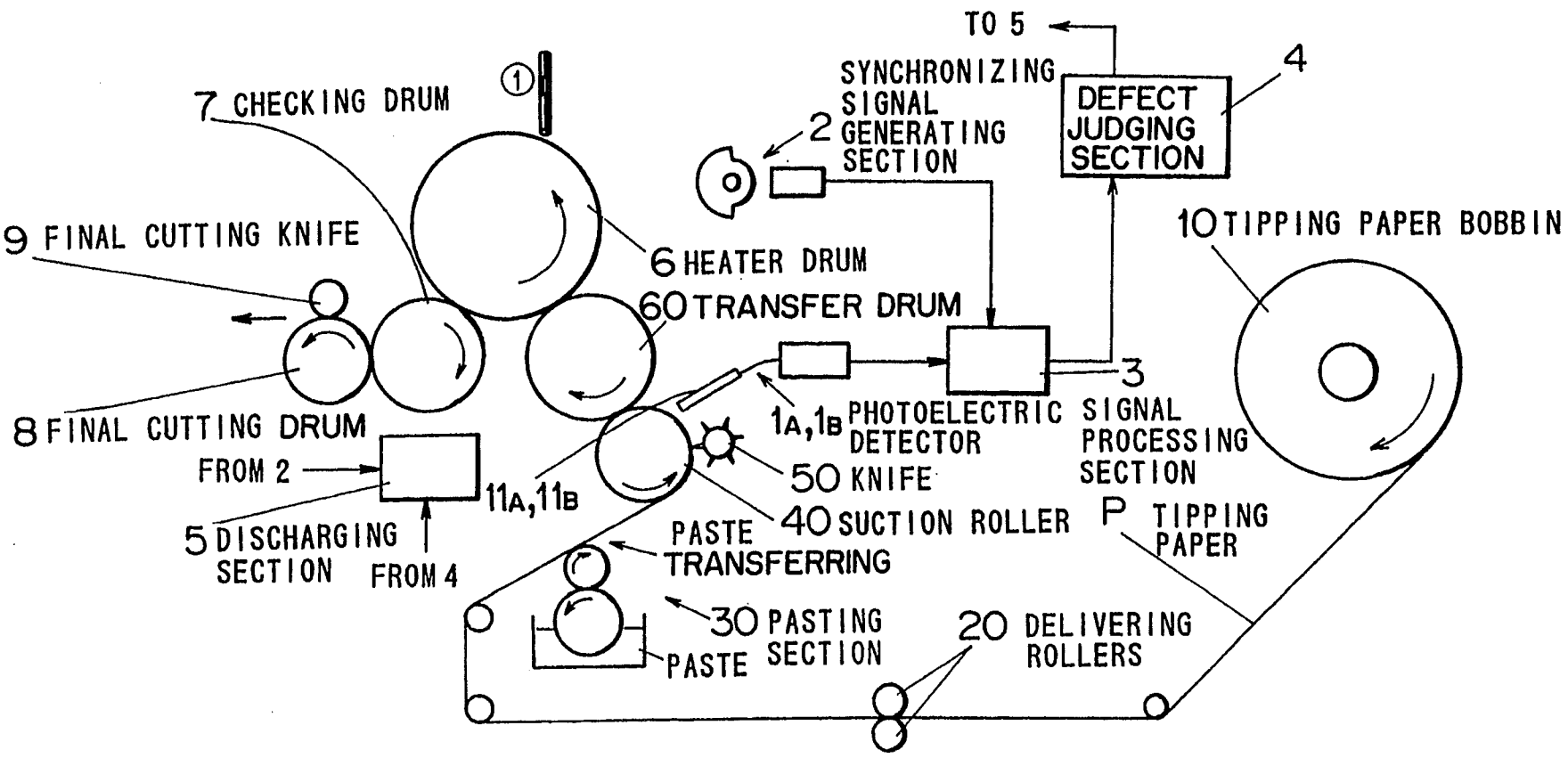
FIG. 1 is a drawing showing a filter tip attaching apparatus for a tobacco manufacturing machine according to the present invention.
Figure 9:
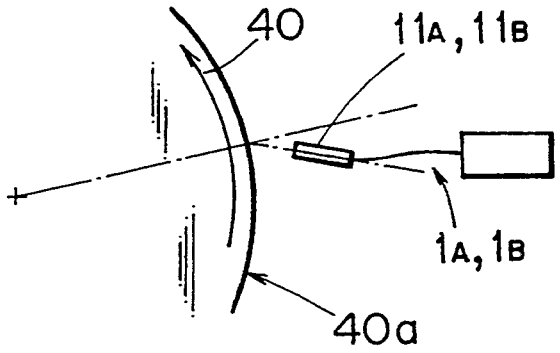
FIG. 9 is a drawing for explaining a position of the photoelectric detector according to the present invention and the conventional system.
Figure 11:
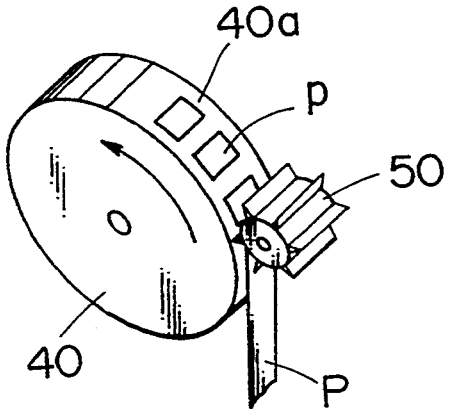
FIG. 11 is drawing showing a portion of the suction roller and a knife according to the present invention and the conventional system.
Figure 10:
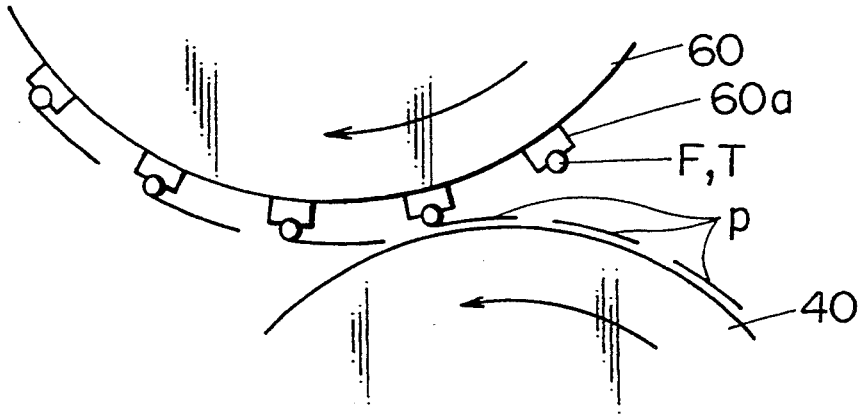
FIG. 10 is a drawing showing a portion of the transfer drum and the suction drum according to the present invention and the conventional system.
Figure 12:
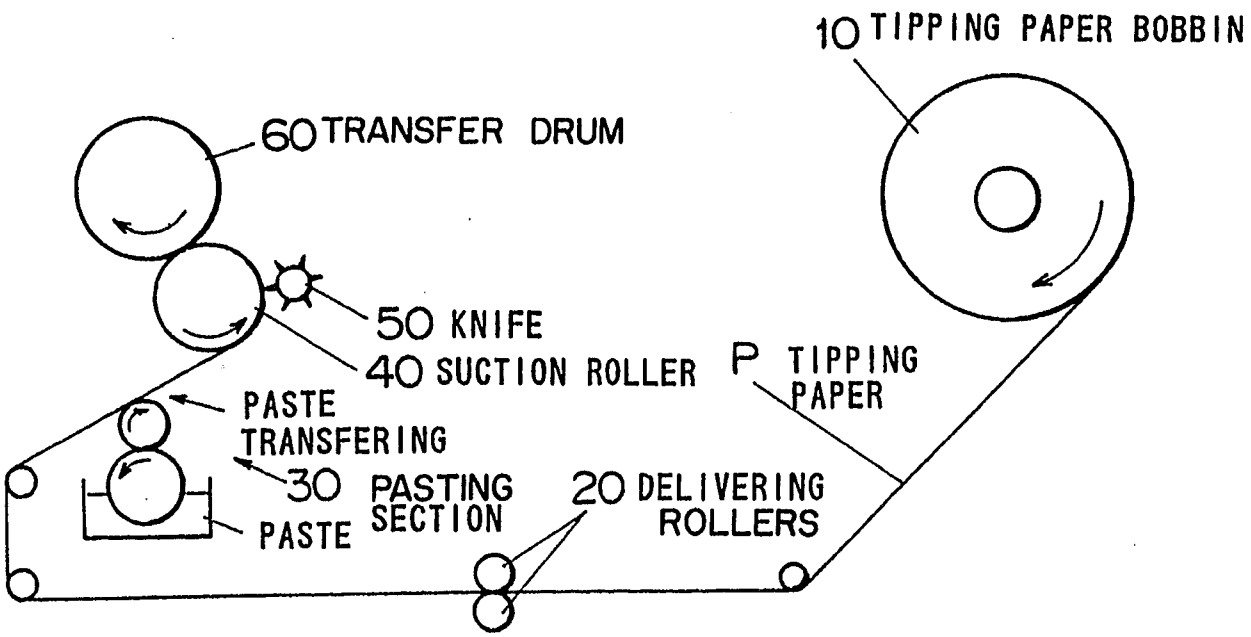
FIG. 12 PRIOR ART
FIG. 12 is a drawing showing a portion for feeding pieces of tip paper according to the conventional system.

FIG. 1 shows a filter tip attaching apparatus for a tobacco manufacturing machine according to the present invention. In the figure, like reference characters designate like or corresponding parts in FIGS. 12 and 9.

In FIG. 1, reference numeral 2 is a synchronizing signal generating section in which a predetermined synchronizing signal is generated in accordance with the rotation of a main shaft of a filter tip attaching apparatus according to the present invention utilizing a contactless sensor 2 or the like. Reference numeral 3 is a signal processing section for outputting count data as time-related information based on an output signal of photoelectric detectors $\mathbf{1}_A$ and $\mathbf{1}_B$ and the synchronizing signal from the synchronizing signal generating section 2 during a period from detection of the synchronizing signal to detection of ends of pieces of tip paper in the direction that the pieces of tip paper are transported. Numeral 4 shows a defect judging section for detecting deviation in position and improper cutting of the pieces p of tip paper and generating an alarm signal. Reference numeral 5 is a discharging section for discharging a defect which is operated in accordance with the alarm signal and the synchronizing signal in an abnormal operation.

When a filter plug and a plain cigarette are rolled by the transfer drum 60, two cigarettes are rolled at the same time as shown in (1) of FIG. 1. Then, a pasted portion of the pieces of tip paper of the double cigarettes are dried by a heater drum 6 to be transferred to a checking drum 7. Further, defective double cigarettes are discharged from the discharging section at the lower portion of the checking drum. On the other hand, normal double cigarettes are cut at the filter portion thereof by a final cutting drum and a final cutting knife 9 and are transferred to the next process.

Figure 2:
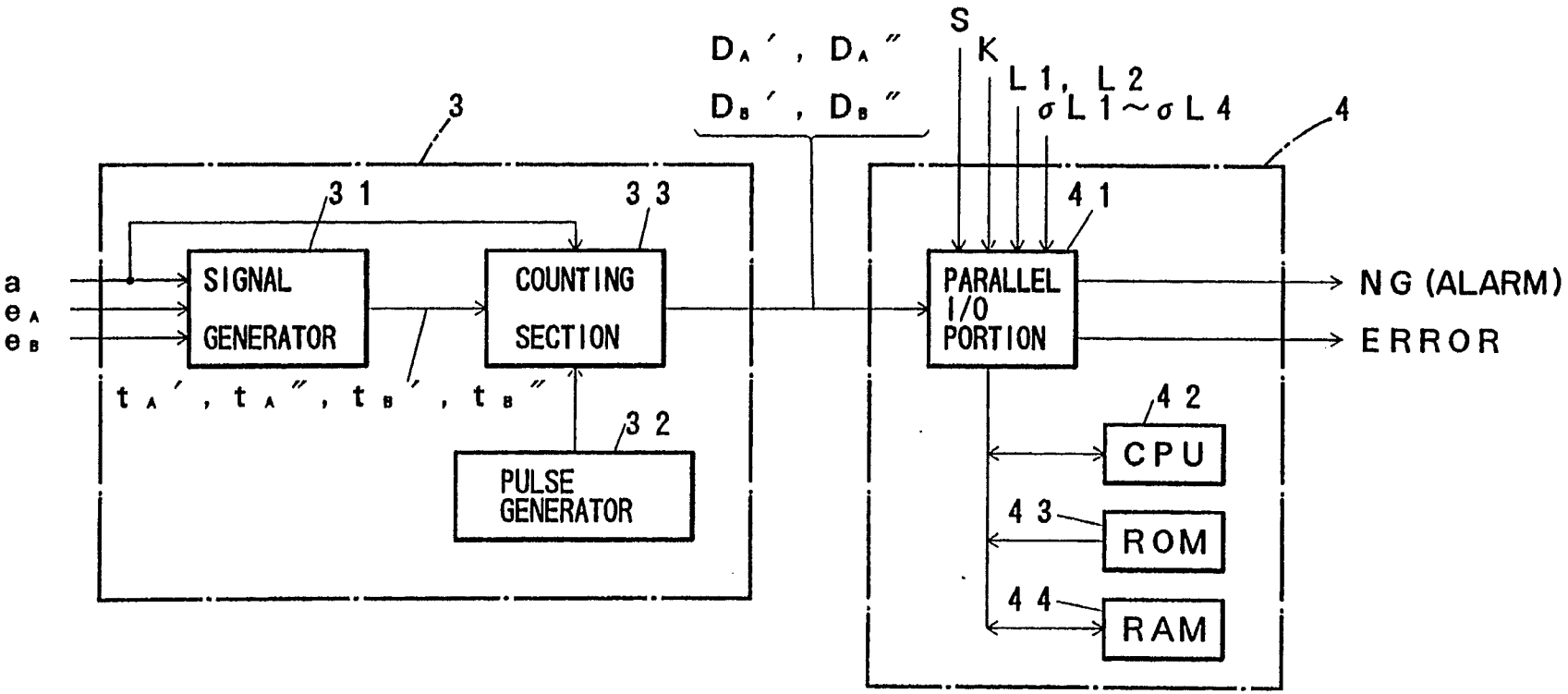
FIG. 2 is a block diagram of signal processing and judging sections according to an embodiment of the present invention.
Figure 3:
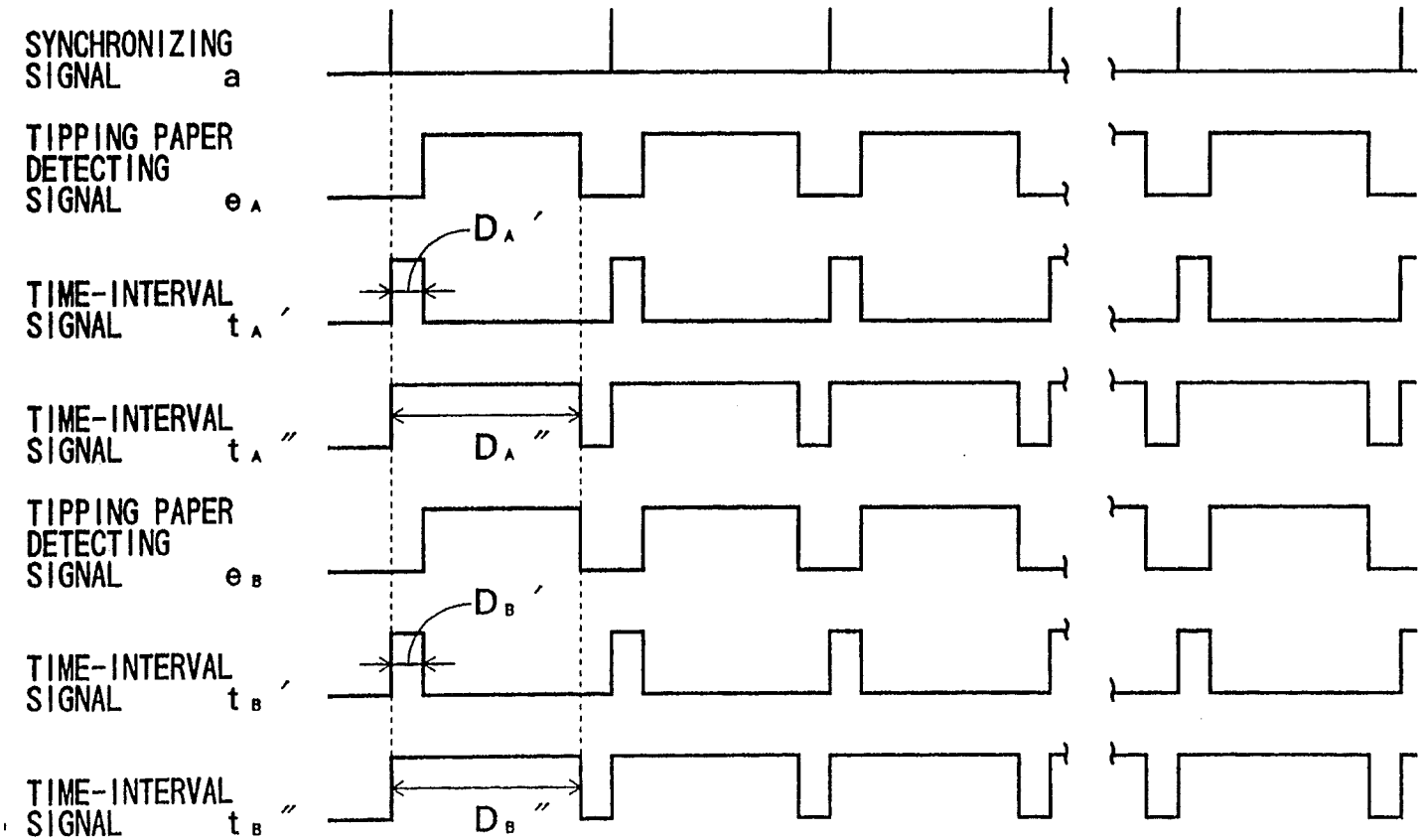
FIG. 3 is a time chart in the signal processing section according to the embodiment.

FIG. 2 is a block diagram of the signal processing section 3 and the defect judging section 4. FIG. 3 shows a time chart for the signal processing section 3.

In the signal processing section 3, a signal generating portion 31 outputs time-interval signals $t_A'$, $t_A''$, $t_B'$, and $t_B''$ based on the synchronizing signals and the tip paper detecting signals $e_A$ and $e_B$ each as described in FIG. 3.

That is, on detecting the synchronizing signals a, the signal generating portion 31 sets the time-interval signals $t_A'$, $t_A''$, $t_B'$, and $t_B''$ to "H" level. Then, on detecting the rising of the tip paper detecting signal $e_A$, the timing signal $t_A'$ is set to "L" level and on detecting the rising of the tip paper detecting signal $e_B$, the timing signal $t_B'$ is set to "L" level. Further, when the falling of the tip paper detecting signal $e_A$, the timing signal $t_A''$ is set to "L" level, and when falling of the tip paper detecting signal $e_B$, the time-interval signal $t_B''$ is set to "L" level.

A pulse generator 32 outputs a pulse signal with a predetermined wave length, for instance, between 200 kHz and 300 kHz to a counting section 33, which counts the pulse signal.

The counting section 33 is provided with counters for the time-interval signals $t_A'$, $t_A''$, $t_B$, respectively and $t_B'$. The counters each start counting with detection of the rising of the time-interval signals $t_A'$, $t_A''$, $t_B'$, and $t_B''$ and finish counting with detection of the falling of the time-interval signals $t_A'$, $t_A''$, $t_B'$, and $t_B''$, respectively. Then, the counted values are latched to output the counted values each as count data $D_A'$, $D_A''$, $D_B'$, and $D_B''$ to the defect judging section 4. The counted value is reset when the next synchronizing signal is detected.

As a result, information on the time interval from the detection of the sychronizing signal to the detection of the fore end or the rear end of pieces p of tip paper in the direction that the tip paper is transported are outputted from the signal processing section 3 to the defect judging section 4.

The defect judging section 4 includes a microcomputer and the count data, $D_A'$, $D_A''$, $D_B'$, and $D_B''$, from the signal processing section 3, command signals S for starting or finishing the detection of the defect, and parameters K, L1, L2, and $\sigma$L1 to $\sigma$L4, for setting the standard for the judgment are inputted to a parallel I/O portion 41. A CPU 42 detects a defect based on the data which is inputted from the parallel I/O portion 41 while using a RAM 44 based on a control program stored in a ROM 43. Then, an alarm signal NG is outputted from the parallel I/O portion 41 to a discharging portion 5.

The command signal S is inputted from a keyboard not shown and the parameters K, L1, L2, $\sigma$L1 to $\sigma$L4 are inputted from dip switches not shown.

Figure 4:
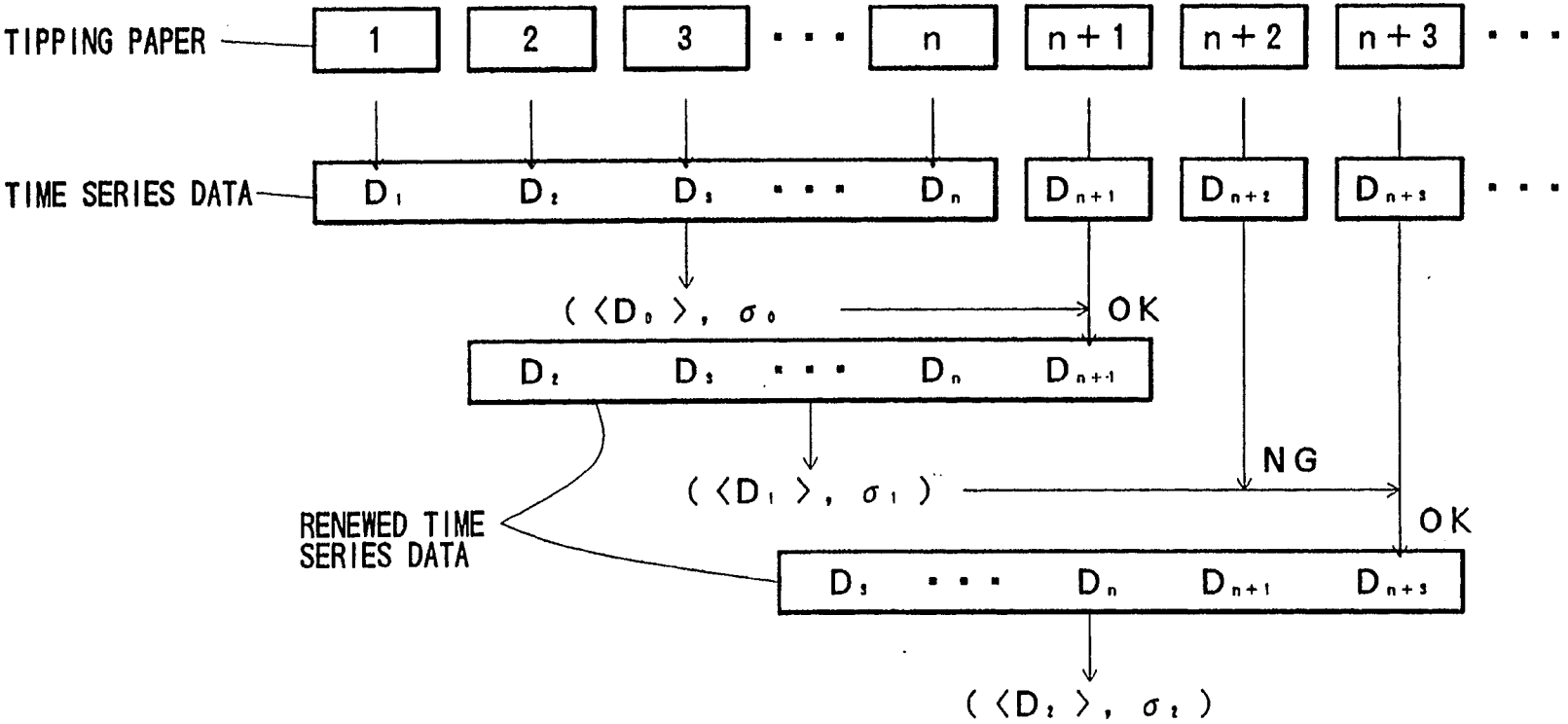
FIG. 4 is a drawing for explaining a conception of method of judging a defect according to the embodiment.

FIG. 4 is a drawing for explaining a conception of method of judging a defect according to the embodiment. For easy understanding, the count data $D_A'$, $D_A''$, $D_B'$, and $D_B''$ according to the lateral ends of the fore end and rear end of the pieces p of tip paper are expressed "Di". The subscript "i" shows the ith piece of tip paper.

First, the count data, "$D_1, D_2, \ldots, D_n$", in accordance with n pieces of tip paper (n=256, in this embodiment) which are transported one after another, are stored as time series data and then the mean value "$<D_o>$" and the standard deviation "$<\sigma_o>$" of the n pieces of count data are calculated. Then, whether or not the count data of the n+1th piece of tip paper satisfies a Formula 1 is checked to judge the condition of the piece of tip paper.

Formula 1

$$|D_{n+1}-<D_o>| \leqq K\sigma_o \quad (1)$$

In the above formula, K shows a parameter (threshold value) which is experimentally obtained.

Next, when the formula is satisfied, the piece of tip paper is judged to be in good condition, and "$D_1$" is removed and "$D_{n+1}$" is added to form n pieces of count data "$D_2, D_3, \ldots, D_{n+1}$". Then, the mean value "$<D_1>$" and the standard deviation "$\sigma_1$" of the n pieces of count data are calculated.

Further, the n+2th piece and the n+3th piece of tip paper are processed in the same manner as the n+1th piece of tip paper. When a piece of tip paper is judged to be defective, the mean value and the standard deviation of the n pieces of data are not renewed, but, the judgment continues while those values being renewed when a piece of tip paper is in good condition.

For example, as illustrated in FIG. 4, when the n+2th piece of tip paper is defective, the count data "$D_{n+3}$" of the n+3th piece of tip paper is judged based on the mean value "$<D_1>$" and "$\sigma 1$". Then, when the n+3th piece of tip paper is good, the mean value and the standard deviation are calculated for the count data of the n pieces of tip paper, "$D_3, \ldots, D_n, D_{n+1}, D_{n+2}$", and the mean value "$<D_2>$" and the standard deviation "$\sigma_2$" calculated are used for judging the condition of the n+4th piece of tip paper.

In this embodiment, the condition of the pieces of tip paper is judged by checking whether or not the count data $D_A'$, $D_A''$, $D_B'$, and $D_B''$ according to the lateral ends of the fore end and rear end of the pieces p of tip paper satisfies the following Formula 2, which corresponds to Formula 1.

Formula 2

$$\left.\begin{array}{ll} |D_A' - <D_A'>| \leqq K\sigma_A', & |D_A'' - <D_A''>| \leqq K\sigma_A'' \\ |D_B' - <D_B'>| \leqq K\sigma_B', & |D_B'' - <D_B''>| \leqq K\sigma_B'' \end{array}\right\} \quad (2)$$

Further, in this embodiment, whether or not all of following Formulas 3 are satisifed is checked to judge the deterioration of the photoelectric detectors $1_A$ and $1_B$. When the formulas are not satisfied, the defect judging section 4 transmits an alarm signal "ERROR" which indicates abnormality in the photoelectric detectors.

Formula 3

$$\left.\begin{array}{ll} <D_A''> - <D_A'> \leqq L1, & <D_B''> - <D_B'> \leqq L2, \\ \sigma_A' \leqq \sigma L1, & \sigma_A'' \leqq \sigma L2, \\ \sigma_B' \leqq \sigma L3, & \sigma_B'' \leqq \sigma L4 \end{array}\right\} \quad (3)$$

In the above formula, L1, L2, $\sigma$L1 to $\sigma$L4 are parameters experimentally obtained.

Figure 5:
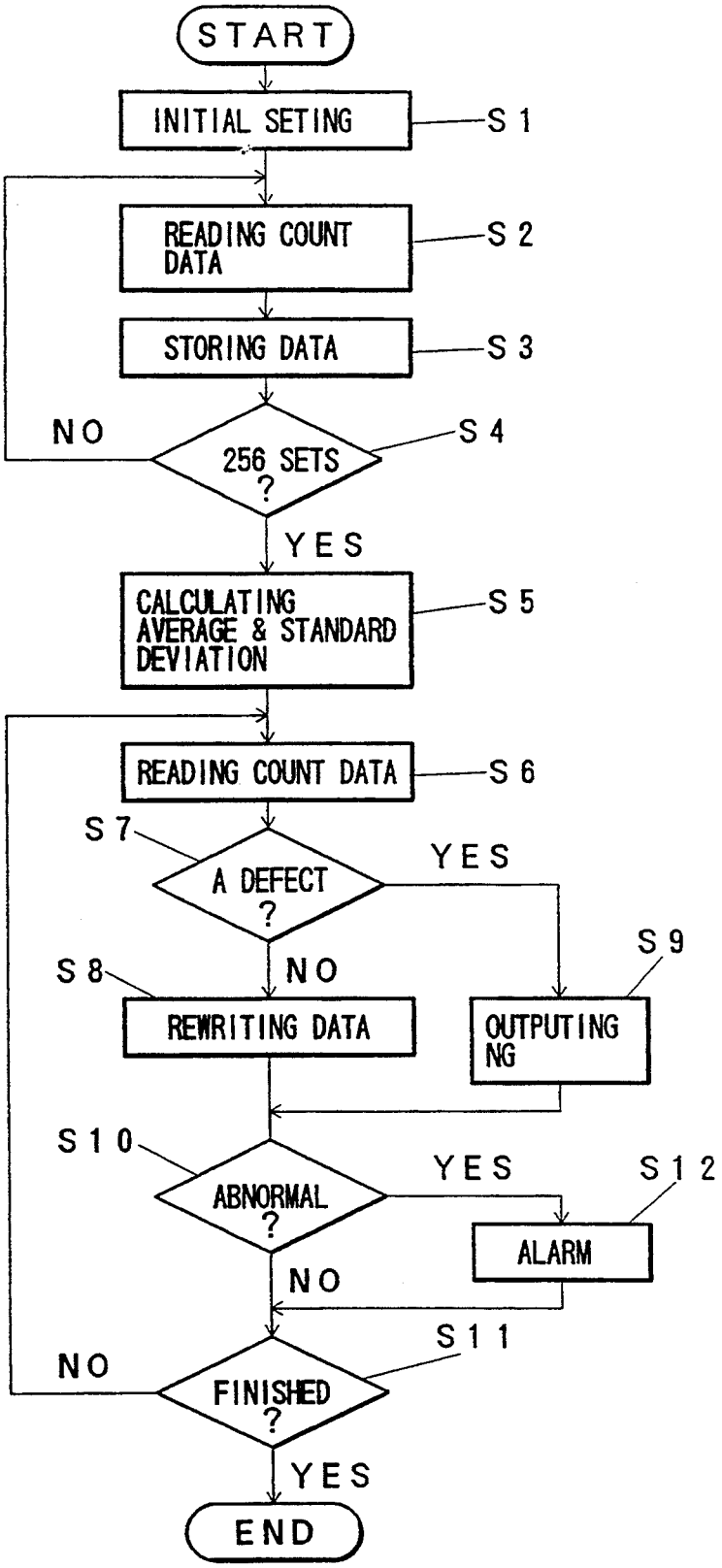
FIG. 5 is a flowchart used for the embodiment according to the present invention.
Figure 6:
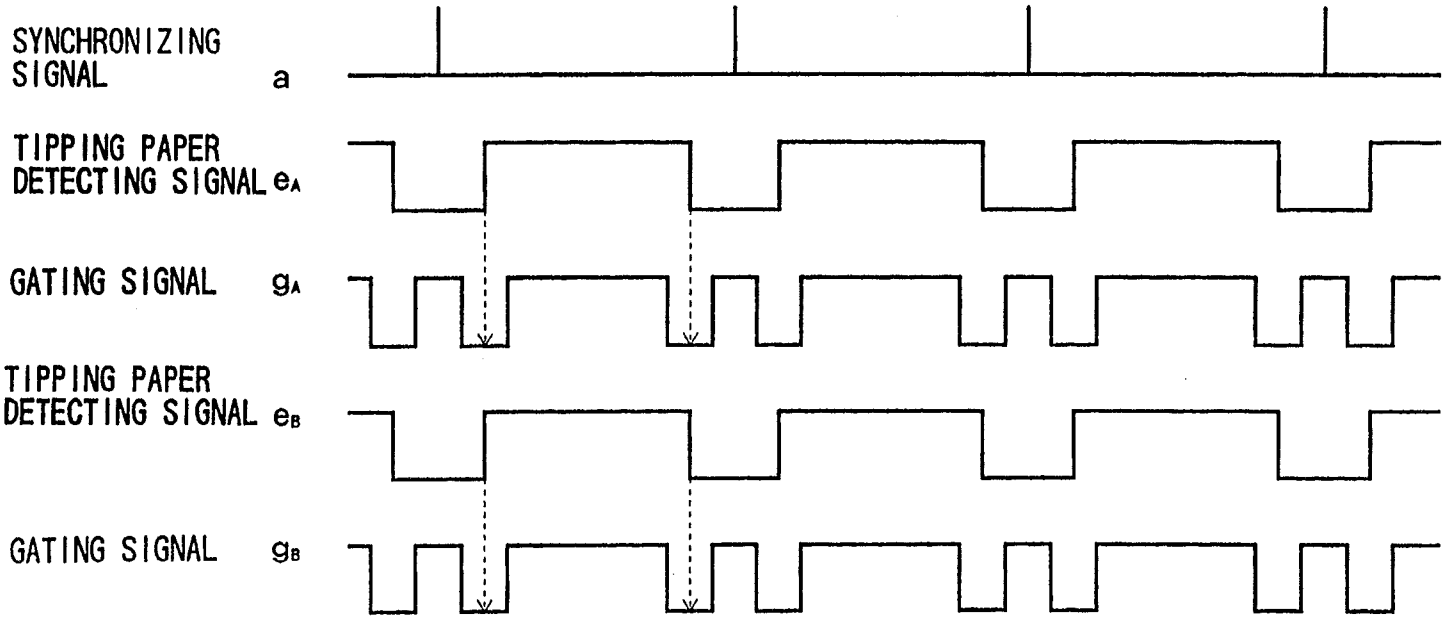
FIG. 6 shows a time chart for signal processing of a conventional method of judging a defect.
Figure 7:
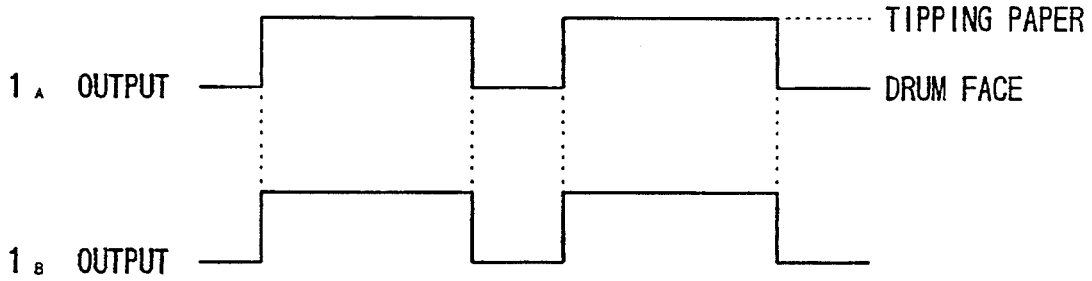
FIG. 7 is a drawing showing output signals of photoelectric detector according to the present invention and the conventional system.
Figure 8:
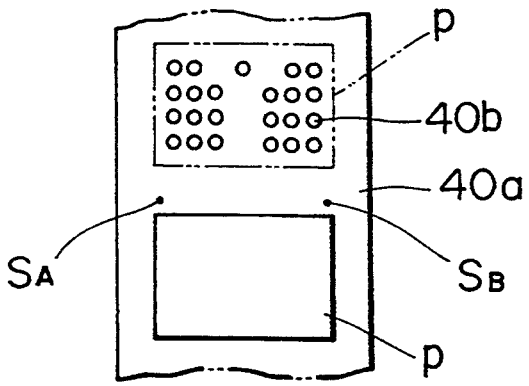
FIG. 8 is a drawing showing a drum face of a suction roller and spots of the photoelectric detector according to the present invention and the conventional system.

FIG. 5 is a flowchart of a control program for the defect judging section in CPU 42. On inputting the command signal S for starting, in Step 1, an initial setting is carried out for reading the paramters K, L1, L2, and $\sigma$L1 to $\sigma$L4 from the parallel I/O portion 41.

Then, in Step 2, the count data $D_A'$, $D_A''$, $D_B'$, and $D_B''$ from the parallel I/O portion 41 are read out, and in Step 3, the data are stored as time series data in a predetermined area of the RAM 44. In step 4, whether or not 256 sets of count data $D_A'$, $D_A''$, $D_B'$, and $D_B''$ are stored are checked. Then, when the number of the data does not reach 256 sets, the procedure from Step 2 is repeated.

On the other hand, when the number of data becomes 256 sets, in Step 5, the mean value $<D_A'>$, $<D_A''>$, $<D_B'>$, and $<D_B''>$, and standard deviation $\sigma_A'$, $\sigma_A''$, $\sigma_B'$ and $\sigma_B''$ are calculated for the data stored in the RAM 44.

Next in Step 6, the count data $D_A'$, $D_A''$, $D_B'$, and $D_B''$ are read out of the parallel I/O portion, and in Step 7, a judgment is made for these data based on the formula 2. Then, when the resultant does not show a defect, the oldest data of the count data each, which are stored in RAM 44, are read to replace those with the data read in Step 6 and then Step 10 is proceeded. Then, if the resultant in Step 7 shows defective, the alarm signal (NG) is outputted in Step 9 to proceed to Step 10.

In Step 10, the abnormality of the photoelectric detector is judged according to the Formulas 3. When the result shows abnormality, an alarm signal is outputted in step 12 to proceed to Step 11.

Then, in case that the signal S for stopping the process is inputted in Step 11, the process stops. On the other hand, the signal S for stoppage is not inputted, the procedure from Step 6 is repeated so that the judgment for the pieces of tip paper each, which is transported one after another, is repeated.

Meanwhile, in the discharging portion 5 to which the alarm signal "NG" is inputted, the alarm signal is stored with the signal being synchronized with the synchronizing signals to adjust the difference in time between the generation of the abnormality and the discharging operation.

That is, the alarm signal is stored until the double filter cigarettes which are rolled with the pieces of tip paper at the abnormality reaches the lower end of the checking drum 7, which permits the defective double cigarettes due to the abnormality to be discharged with certainty.

As described above, in order to store and delay the alarm signal so as to be sychronized with the synchronizing signals, a multiple shifting circuit may be used, which performs shifting operation according to the synchronizing signals, so that output signals of the circuit may control the discharging operation.

In the above embodiment, the method of detecting the deviation in position and misshape of the pieces of tip paper is explained, but, this method may be applied to detect deviation in position and misshape of the double cigarettes, which is transported by the transfer drum as initially pasted cigarettes or which is dried by the heater drum. Further, this method may be applied to a transporting process for other manufacturing system besides tobacco manufacturing system.

As described above, in the method according to the present invention, objects with predetermined shape are successively transported at predetermined intervals with the transported objects being maintained in the prescribed direction, and synchronizing signals which corresponds to the transportation intervals are generated on a predetermined cycle to detect the deviation in position and misshape of the double cigarettes based on the time interval between the passage of the transported objects in the direction the objects are transported and the emission of the synchronizing signal. Then, the mean value and standard deviation are calculated from a predetermined number of time series information on the transported objects. Next, when the difference between the measured time interval and the mean time interval is larger than a criterion which is calculated based on the standard deviation, the transported object is to be judged as objects of which position is deviated or shape is deformed. In addition, the oldest information on the time interval in the above time series information is replaced with information on the time interval for the object of which position is not deviated or shape is not deformed. Then, the mean value and standard deviation are calculated for the renewed time series information so as to be used for the judgment. As a result, the criterion is determined based on the predetermined number of transported objects which are not defects and any deviation in a long period of time is not contained in the criterion, which improves the accuracy of the detection. In addition to the above, the adjustment of the width of the gating signals, which is inevitable in the conventional method, becomes unnecessary in the method according to the present invention.

What is claimed is:

1. A method of detecting deviation in position and misshape of transported objects which have a predetermined shape and are successively transported at predetermined intervals along a path with said transported objects being maintained in a predetermined orientation, comprising the steps of:

transporting the object along the path;

generating synchronizing signals corresponding to said transportation intervals on a predetermined cycle;

detecting passage of end portions of said transported objects at predetermined path positions;

calculating a interval between the generation of said synchronizing signal and the passage of said end portions;

calculating a mean value and a standard deviation for a prescribed number of said transported objects from time series information;

judging a transported object as an object of which position is deviated or shape is deformed when the difference between measured time interval and said mean time interval is larger than a criterion which is calculated based on said standard deviation;

replacing the oldest information on the time interval in said time series information with information on time interval of a transported object which is judged that a position thereof is not deviated or a shape thereof is not deformed to renew the time series information; and calculating a mean value and a standard deviation for said renewed time series information so as to be used for said judgment.

2. A method for detecting a deviation of an object from a desired state, said object being transported along a path in a serial fashion in a stream formed of a plurality of substantially similar discrete objects, comprising the steps of:

transporting the objects along the path;

producing periodic synchronizing signal pulses;

producing an alpha signal when said object reaches a first reference point on said path;

producing a beta signal when said object has passed said first reference point;

counting an alpha count, starting with said alpha signal and stopping upon detecting a synchronizing pulse subsequent to said alpha count being started;

counting a beta count, starting with said beta signal and stopping upon detecting a synchronizing pulse subsequent to said beta count being started;

comparing a function of said alpha count against a desired comparison value to produce an alpha comparison;

comparing a function of said beta count against a desired comparison value to produce a beta comparison; and determining as a function of said alpha and beta comparisons whether an object's state deviates from a desired state.

3. A method as in claim 2, wherein:

said first reference point is located near a first boundary, said first boundary being a function of said desired state of said object.

4. A method as in claim 2, further comprising the steps of:

producing a gamma signal when said object reaches a second reference point on said path;

producing a delta signal when said object has passed said second reference point;

counting a gamma count, starting with said second start signal and stopping upon detecting a synchronizing pulse subsequent to said gamma count being started;

counting a delta count, starting with said second start signal and stopping upon detecting a synchronizing pulse subsequent to said delta count being started;

comparing a function of said gamma count against a desired value to produce a gamma comparison;

comparing a function of said delta count against a desired value to produce a delta comparison; and determining as a function of said gamma and delta comparisons whether an object's state deviates from a desired state.

5. A method as in claim 4, wherein:

said second reference point is located near a second boundary, said second boundary being a function of said desired state of said object, and said second reference point is a significant distance, relative to said desired state of said object, from said first reference point.

6. A method as in claim 2, wherein said step of comparing includes:

determining at least one difference between at least one of said alpha and beta counts and a desired count.

7. A method as in claim 6, wherein:

said desired comparison value is a function of a standard deviation of said difference.

8. A method as in claim 7, wherein:

said desired comparison value is a function of said standard deviation scaled by a scalar.

9. A method as in claim 7, wherein:

said standard deviation is a moving standard deviation value.

10. A method as in claim 6, wherein:

said desired count is an average of any one of said counts.

11. A method as in claim 10, wherein:

said average is a moving average.

12. A method as in claim 2, wherein:

the path being at least part of a cigarette manufacturing assembly line; and said object is tip paper, said tip paper being a component in cigarette manufacture.

13. A method as in claim 2, wherein:

the path being at least part of a cigarette manufacturing assembly line; and said object is a double cigarette, said double cigarette being an intermediate product in cigarette manufacture.

14. A method as in claim 2, wherein:

said desired state is a desired position of said object, and said step of determining determines deviation of a position of said object from said desired position.

15. A method as in claim 2, wherein:

said desired state is a desired shape of said object, and said step of determining determines deviation of a shape of said object from said desired shape.

16. An apparatus for detecting a deviation of an object from a desired state, said object being transported along a path in a serial fashion in a stream formed of a plurality of substantially similar discrete objects, comprising:

means for transporting the objects along the path;

a pulse generator producing periodic synchronizing signal pulses;

an alpha detector producing an alpha signal when said object reaches a first reference point on said path;

a beta detector producing a beta signal when said object has passed said first reference point;

an alpha counter counting an alpha count, starting with said alpha signal from said alpha detector and stopping upon detecting a synchronizing pulse from said pulse generator subsequent to said alpha count being started;

a beta counter counting a beta count, starting with said beta signal from said beta detector and stopping upon detecting a synchronizing pulse from said pulse generator subsequent to said beta counter being started;

an alpha comparator comparing a function of said alpha count from said alpha counter against a desired comparison value to produce an alpha comparison;

a beta comparator comparing a function of said beta count from said beta counter against a desired comparison value to produce a beta comparison; and first determining means for determining as a function of said alpha comparison from said alpha comparator and beta comparison from said beta comparator whether an object's state deviates from a desired state.

17. An apparatus as in claim 16, wherein:

said first reference point is located near a first boundary, said first boundary being a function of said desired state of said object.

18. An apparatus as in claim 16, further comprising:

a gamma detector producing a gamma signal when said object reaches a second reference point on said path;

a delta detector producing a delta signal when said object has passed said second reference point;

a gamma counter counting a gamma count, starting with said gamma signal from said gamma detector and stopping upon detecting a synchronizing pulse from said pulse generator subsequent to said gamma count being started;

a delta counter counting a delta count, starting with said delta signal from said delta detector and stopping upon detecting a synchronizing pulse from said pulse generator subsequent to said delta count being started;

a gamma comparator comparing a function of said gamma count from said gamma counter against a desired value to produce a gamma comparison;

a delta comparator comparing a function of said delta count from said delta counter against a desired value to produce a delta comparison; and second determining means for determining as a function of said gamma comparison from said gamma comparator and delta comparison from said delta comparator whether an object's state deviates from a desired state.

19. An apparatus as in claim 18, wherein:

said second reference point is located near a second boundary, said second boundary being a function of said desired state of said object, and said second reference point is a significant distance, relative to said desired state of said object, from said first reference point.

20. An apparatus as in claim 16, wherein at least one of said alpha and beta comparators comprises:

difference means for determining a difference between the corresponding alpha count from said alpha counter or beta count from said beta counter and a desired count.

21. An apparatus as in claim 20, wherein:

said desired comparison value is a function of a standard deviation of said difference.

22. An apparatus as in claim 21, wherein:

said desired comparison value is a function of said standard deviation scaled by a scalar.

23. An apparatus as in claim 21, wherein:

said standard deviation is a moving standard deviation value.

24. An apparatus as in claim 20, wherein:

said desired count is an average of any one of said counts.

25. An apparatus as in claim 24, wherein:

said average is a moving average.

26. An apparatus as in claim 16, wherein:

the path being at least part of a cigarette manufacturing assembly line; and said object is tip paper, said tip paper being a component in cigarette manufacture.

27. An apparatus as in claim 16, wherein:

the path being at least part of a cigarette manufacturing assembly line; and said object is a double cigarette, said double cigarette being an intermediate product in cigarette manufacture.

28. An apparatus as in claim 16, wherein:

each of said detectors is a photodetector.

29. An apparatus as in claim 16, wherein:

said desired state is a desired position of said object and said first determining means determines deviation of a position of said object from said desired position.

30. An apparatus as in claim 16, wherein:

said desired state is a desired shape of said object, and said first determining means determines deviation of a shape of said object from said desired shape.

* * * * *